US005688079A

United States Patent [19]

Bolduc et al.

[11] Patent Number: 5,688,079

[45] Date of Patent: Nov. 18, 1997

[54] CONSTRUCTION BLOCK FOR BUILDING A RETAINING WALL

[75] Inventors: Maurice Bolduc, Sainte-Marie-de-Beauce; Marco Couture, Ste-Marie-de-Beauce, both of Canada

[73] Assignee: Béton Bolduc (1982) Inc., Ste-Marie-de-Beauce, Canada

[21] Appl. No.: 630,448

[22] Filed: Apr. 10, 1996

[51] Int. Cl.[6] ..... E02D 29/02

[52] U.S. Cl. ..... 405/286; 405/284; 405/262; 52/592.6; 52/596; 52/604

[58] Field of Search ..... 405/286, 285, 405/284, 262, 273, 258; 52/606, 605, 604, 603, 607, 596, 592.6

[56] References Cited

U.S. PATENT DOCUMENTS

| | | | |
|---|---|---|---|
| 2,313,363 | 3/1943 | Schmitt . | |
| 4,490,075 | 12/1984 | Risi et al. | 405/273 |
| 4,815,897 | 3/1989 | Risi et al. | 405/284 |
| 4,860,505 | 8/1989 | Bender | 405/286 |
| 4,993,206 | 2/1991 | Pardo | 405/286 |
| 5,017,049 | 5/1991 | Sievert | 405/285 |
| 5,064,313 | 11/1991 | Risi et al. | 405/286 X |
| 5,248,226 | 9/1993 | Risi et al. | 405/284 |
| 5,557,198 | 9/1996 | Schaaf et al. | 52/604 |
| 5,598,679 | 2/1997 | Orton et al. | 405/286 X |
| 5,622,456 | 4/1997 | Risi et al. | 405/286 X |

*Primary Examiner*—Tamara L. Graysay
*Assistant Examiner*—Frederick L. Lagman
*Attorney, Agent, or Firm*—ROBIC

[57] ABSTRACT

The construction block has a projection approximately centered on its top surface. The construction block also has a groove at each of the opposite ends on its bottom surface, each groove being approximately centered about the longitudinal axis. The construction block further has at least one slot defining an end piece, transverse to the longitudinal axis, on the top surface or the bottom surface, located approximately halfway between the center point and one of the opposite ends. The block may be stacked on two identical blocks having their opposite ends facing each other, with the block resting on half of each of the two identical blocks, so that the groove at one of the opposite ends of the block is located above half of the projection of one of the identical blocks and the groove at the other opposite end is located above half of the projection of the other identical block, thus staggering the blocks. Furthermore, the one slot makes it possible to have the end piece slitted and cut off from the block to be used as an end block for a retaining wall having a straight edge, by having the groove of the end piece located above half of the projection of the block having had its end piece slitted and cut off.

19 Claims, 8 Drawing Sheets

CONSTRUCTION BLOCK FOR BUILDING A RETAINING WALL

FIELD OF THE INVENTION

The present invention relates to a construction block for building a retaining wall which may be straight or right-angled.

The invention also relates to units made of a plurality of such blocks connected to each other side by side.

DESCRIPTION OF THE PRIOR ART

Construction blocks for building retaining walls are known per se in the art. For example, reference may be made to Canadian patent 1,182,295 and its U.S. counterpart U.S. Pat. No. 4,490,075, which disclose a retaining wall system using interlocking blocks to build the wall, that is naturally inclined to the vertical at a predetermined angle. The blocks have projecting means on the top surface and recess means on the bottom surface such that when the blocks are staggered and interlocked, they are in sliding fit with each other. The projecting means and the recess means are offset with respect to each other by a predetermined amount in order to provide for the desired angle of inclination of the assembled wall.

Reference may also be made to U.S. Pat. Nos. 5,017,049 (Sievert), 2,313,363 (Schmitt), 5,248,221 (Risi—equivalent to Canadian patent 2,045,953) and 4,815,897 (Risi—equivalent to Canadian patent 1,204,296) which disclose blocks used in building retaining walls.

One of the disadvantages with the above-mentioned construction blocks is that although they may interlock, they cannot easily be converted into end blocks to form an even edge at the ends of the wall. Another disadvantage is that they are laterally unstable, given their longitudinal sliding fit.

Furthermore, none of these blocks may be used to build a retaining wall and, using the same block, also interlock a side wall at a right angle to the retaining wall in order to form a U-shaped or an L-shaped wall. A separate block or device must be used in order to provide for the possibility of making a corner.

SUMMARY OF THE INVENTION

It is a first object of the invention to provide a construction block for building a retaining wall which can also be used to make an end block, and which is laterally stable.

In accordance with the invention, this first object is achieved with a construction block having a length L, a width W, a thickness T, two opposite ends, two opposite sides, a top surface, a bottom surface, a longitudinal axis and a center point on said top surface. The construction block comprises:

- a projection having a length l, a width w and a thickness t, approximately centered about the center point, on the top surface;
- a groove at each of the opposite ends on said bottom surface, each groove having a length l", a width w" and a thickness t", approximately centered about the longitudinal axis; and
- at least one slot, transverse to the longitudinal axis, on either the top surface or the bottom surface, located approximately halfway between the center point and one of the opposite ends, the at least one slot defining an end piece, where l, w, t, l", w" and t" meet the following equations:

$$l''>\tfrac{1}{2}l;$$

$$t''>t; \text{ and}$$

$$w''>w.$$

In use, the block may be stacked on two identical blocks having their opposite ends facing each other, with the block resting on half of each of the two identical blocks, so that the groove at one of the opposite ends of the block is located above half of the projection of one of the identical blocks and the groove at the other opposite end is located above half of the projection of the other identical block, thus staggering the blocks. Furthermore, the one slot makes it possible to have the end piece slitted and cut off from the block to be used as an end block for a retaining wall having a straight edge, by having the groove of the end piece located above half of the projection of the block having had its end piece slitted and cut off.

It is a second object of the invention to provide a construction block for building a retaining wall which can also be used as a corner block, and which is laterally stable, hereinafter referred to as a "construction corner block".

In accordance with the invention, this second object is achieved with a construction corner block having a length L, a width W, a thickness T, an outside end, an inside end, two opposite sides, a top surface, a bottom surface, a longitudinal axis and a center point on said top surface. The construction corner block comprises:

- a projection on the top surface, having a length l, a width w and a thickness t, approximately centered about the center point;
- a groove at each of the opposite ends on said bottom surface, each groove having a length l", a width w" and a thickness t", approximately centered about the longitudinal axis;
- at least one slot, transverse to the longitudinal axis, on either the top surface or the bottom surface, located at a distance S from the center point near the outside end, the at least one slot defining a corner piece; and
- a transverse groove, having an opening on one or the other of the opposite sides on the bottom surface, the transverse groove being located approximately halfway between the center point and the slot and having a length l', a width w', and a thickness t', where L, W, S, l, w, t, l', w', t', l", w" and t" meet the following equations:

$$l'>\tfrac{1}{2}l;$$

$$w'>w;$$

$$t'>t;$$

$$l''>\tfrac{1}{2}l;$$

$$t''>t;$$

$$w''>w; \text{ and}$$

$$S\approx W.$$

In use, the corner block may be stacked on two identical blocks, or on two construction blocks or on a combination of both, having their opposite ends facing each other, with the corner block resting on half of each of the two blocks, so that the groove at one of the opposite ends of the corner block is located above half of the projection of one of the blocks and the groove at the other opposite end is located above half of the projection of the other block, thus staggering the blocks. Furthermore, the corner block may be used to form a corner by having the corner piece slitted and cut off from the corner block and have the corner block located adjacent another block with their longitudinal axes perpendicular to each other and have the transverse groove of the corner block aligned with one of the grooves of the other block.

A third object of the present invention is also to provide multiple retaining wall block units made of a plurality of construction blocks or construction corner blocks as defined above, or of a combination of both.

BRIEF DESCRIPTION OF THE DRAWINGS

The present invention and its advantages will be more easily understood after reading the following non-restrictive description of a preferred embodiment thereof, made with reference to the following drawings where:

FIG. 13A is the bottom row and FIG. 13B is the top row, according to one preferred embodiment of making a corner; FIG. 14A is the bottom row and FIG. 14B is the top row, according to another preferred embodiment of making a corner.

DESCRIPTION OF A PREFERRED EMBODIMENT OF THE INVENTION

The invention is concerned with two variants of a block for building a retaining wall, a "construction block" and a "construction corner block", having essentially the same basic structure. The invention is also concerned with multiple retaining wall units made of such blocks. For the purposes of simplicity, the same numerals will be used to refer to similar parts in each block.

1. Construction Block

Figure 3:
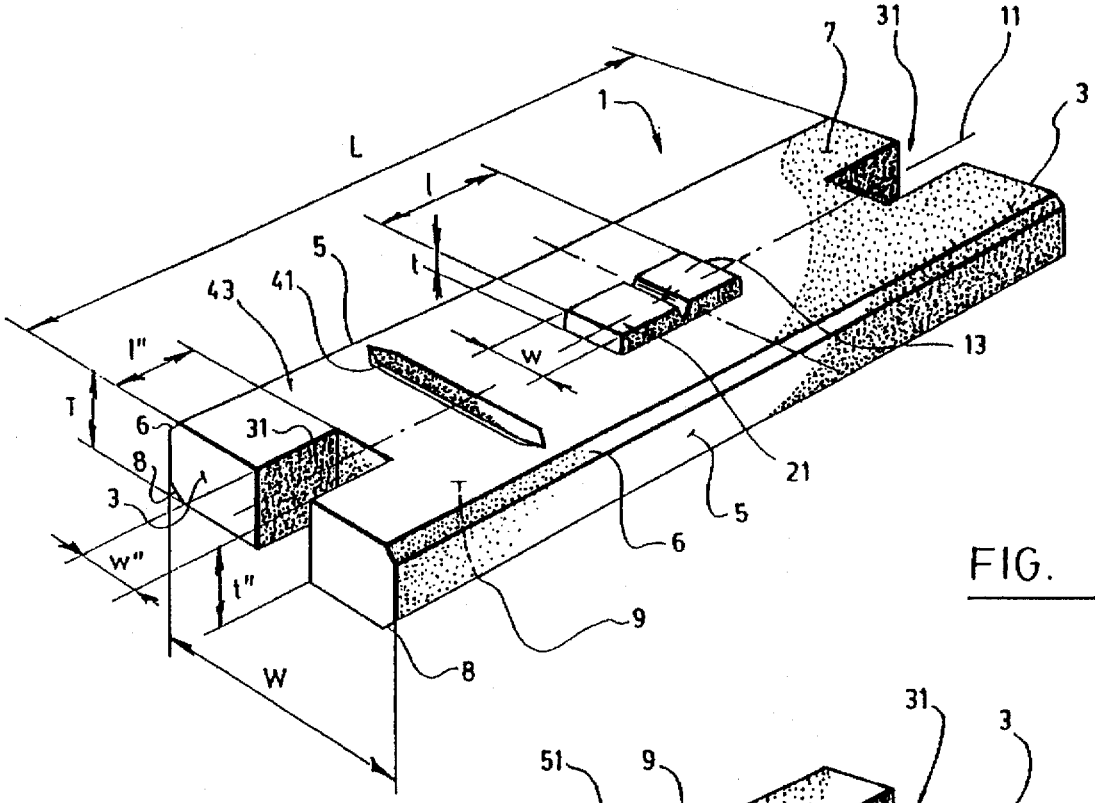
FIG. 3 is a top perspective view of a construction block according to a preferred embodiment of the invention.
Figure 4:
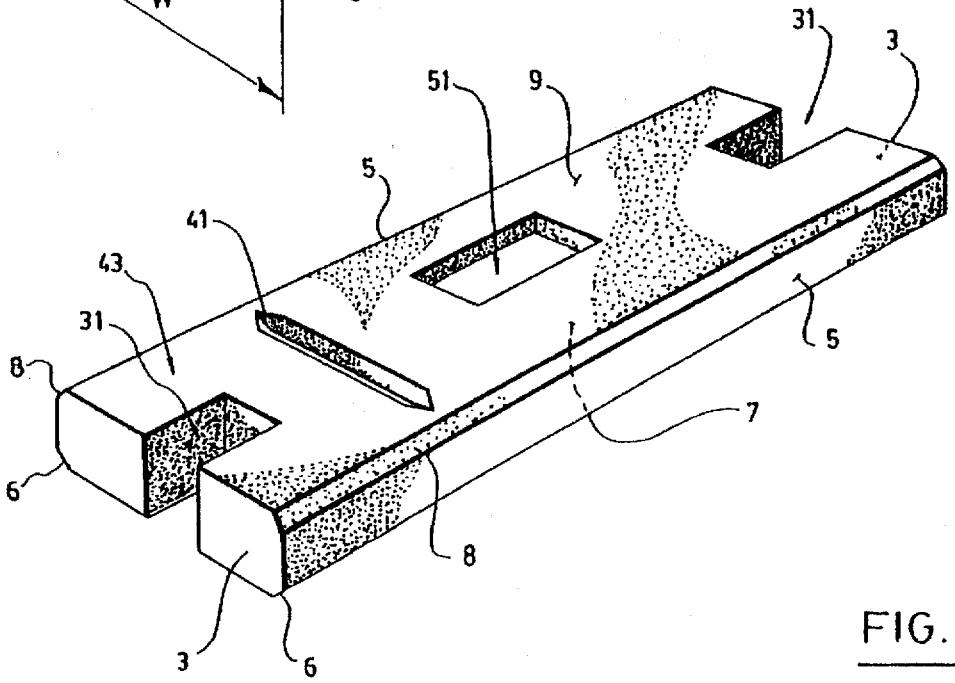
FIG. 4 is a bottom perspective view of the construction block of FIG. 3.

Referring to FIG. 3, there is shown a construction block 1 for building a retaining wall according to a first preferred embodiment of the invention. The construction block 1 according to this first preferred embodiment has a length L, a width W, a thickness T, two opposite ends 3, two opposite sides 5, a top surface 7, a bottom surface 9, a longitudinal axis 11 and a center point 13 on the top surface 7. It is preferable for at least one of the opposite sides 3 to have bevelled edges 6, 8 although the construction block 1 of FIGS. 3 and 4 has bevelled edges 6 on both of the opposite sides 3. For aesthetic purposes, the bevelled edges 6, 8 are deeper than the bevelled edges 8.

The construction block 1 comprises a projection 21 having a length l, a width w and a thickness t, approximately centered about the center point 13, on the top surface 7. Preferably, the projection 21 is inwardly and upwardly tapered, the purpose of which will be detailed hereinafter.

The construction block 1 also comprises a groove 31 at each of the opposite ends 3 on the bottom surface 9, each groove 31 having a length l", a width w" and a thickness t", approximately centered about the longitudinal axis 11.

On either the top surface 7 or the bottom surface 9 or both, there is at least one slot 41, ideally two slots 41, oriented in a direction transverse to the longitudinal axis 11. Each slot 41 is preferably V-shaped as shown on FIGS. 3 and 4, and located approximately halfway between the center point 13 and one of the opposite ends 3. Advantageously, the slot 41 on the top surface 7 is deeper than the slot 41 on the bottom surface 9. The slots thus define an "end piece" 43.

The length l, width w, thickness t, length l", width w" and thickness t" of the construction block 1 are selected so that they meet the following equations:

$$l'' > \tfrac{1}{2} l;$$

$$t'' > t; \text{ and}$$

$$w'' > w.$$

Preferably, however, the thickness t" should equal the thickness T of the construction block 1.

In use, the construction block 1 may be stacked on two identical construction blocks 1, 1, or on two construction corner blocks as hereinafter defined or on a combination of a construction block and a construction corner block, having their opposite ends 3 facing each other, with the construction block 1 resting on half of each of the two identical blocks 1, 1, so that the groove 31 at one of the opposite ends 3 of the block 1 is located above half of the projection 21 of one of the identical blocks 1 and the groove 31 at the other opposite end 3 is located above half of the projection 21 of the other identical block 1, thus staggering said blocks, as better shown on FIGS. 1 and 2. This feature of the invention provides a laterally stable assembly, as the size of the slot 31 and the projection 21 are selected so as to prevent the staggered blocks 1, 1, 1 from sliding along the longitudinal axis 11 of the block 1. Additionnally, the inwardly, upwardly tapered projection 21 of the block permits snug fitting of the grooves 31 on each side, and allows for variances in the size of the slots and the projection during manufacture.

Furthermore, the slots 41 make it possible to have the end piece 43 slitted and cut off from the block 1 by using, for example, a chisel and a hammer. The end piece 43 may be used as an end block for a retaining wall having a straight edge, by having the groove 31 of the end piece 43 located above half of the projection 21 of the block 1 having had its end piece 43 slitted and cut off as shown on FIG. 2 by the arrow.

Figure 8:
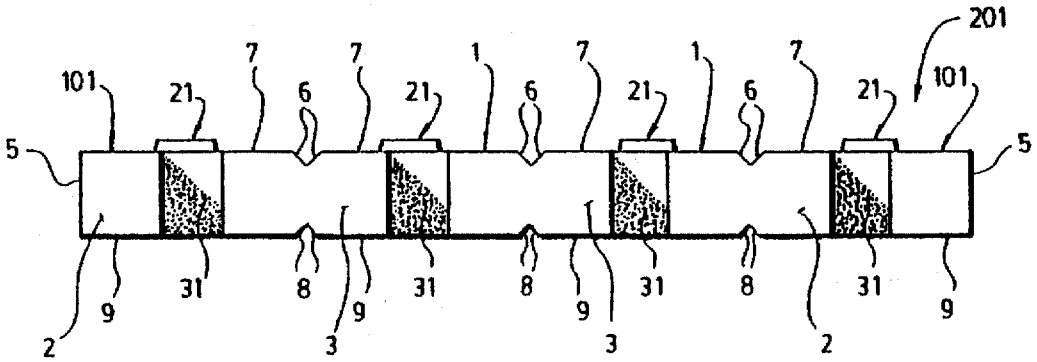
FIG. 8 is a front elevational view of the multiple retaining wall unit of FIG. 7.
Figure 9:
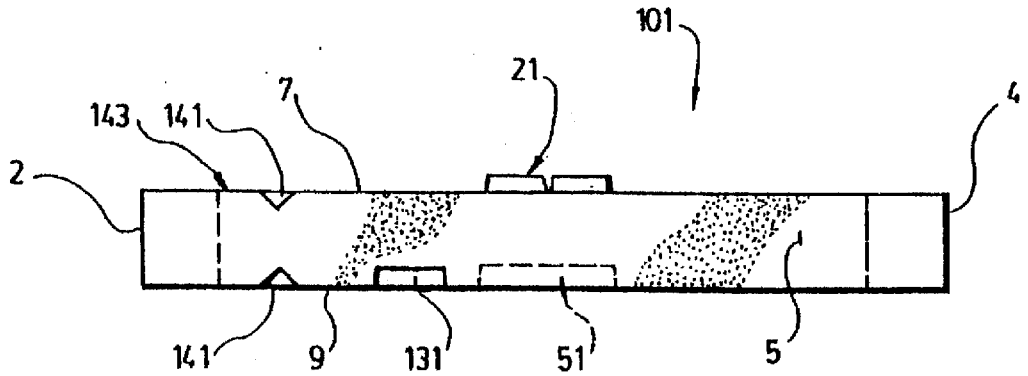
FIG. 9 is a side elevational view of the construction corner block at one end of the multiple retaining wall unit of FIG. 7.
Figure 10:
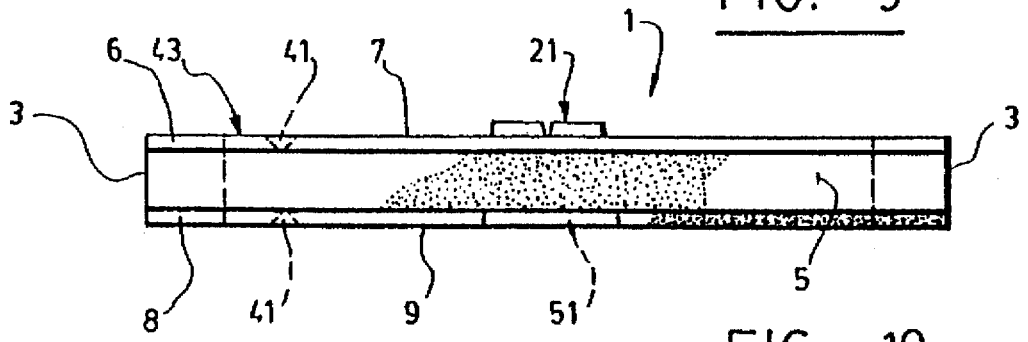
FIG. 10 is a side elevational view of the construction block of the multiple retaining wall unit of FIG. 7.
Figure 11:
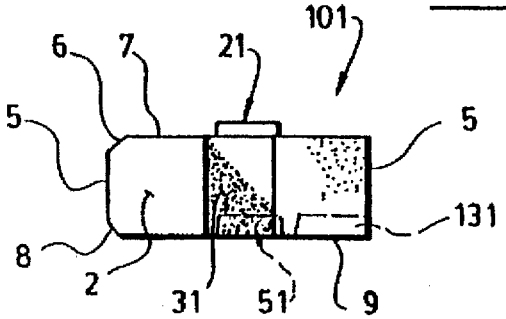
FIG. 11 is a front elevational view of the construction corner block of FIG. 9.
Figure 12:
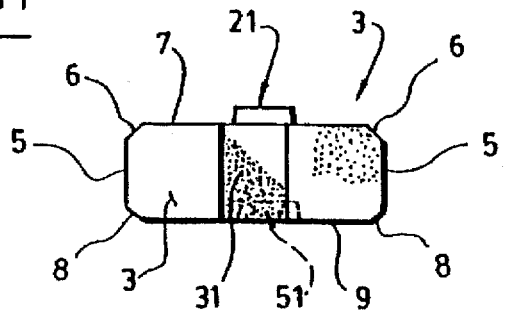
FIG. 12 is a front elevational view of the construction block of FIG. 10.

At times it may be necessary to build a retaining wall which can be either inwardly or outwardly staggered in order to comply with applicable regulations. Thus, the projection 21 on the top surface 7 of the construction block 1 is preferably transversely offset with respect to the longitudinal axis 11, as better shown on FIGS. 8, 11 and 12. When a plurality of blocks are staggered and stacked one on top of the other in rows such as in FIGS. 1 and 2, the offset projection results in that each row that is stacked and staggered one on top of the other is uniformly set back or set forward from the row of blocks below it. This feature is better shown on FIG. 2, showing an inwardly staggered wall. Preferably, the projection is offset so as to gradually set back or set forward each row by a distance of 8 mm.

2. Construction Corner Block

Figure 5:
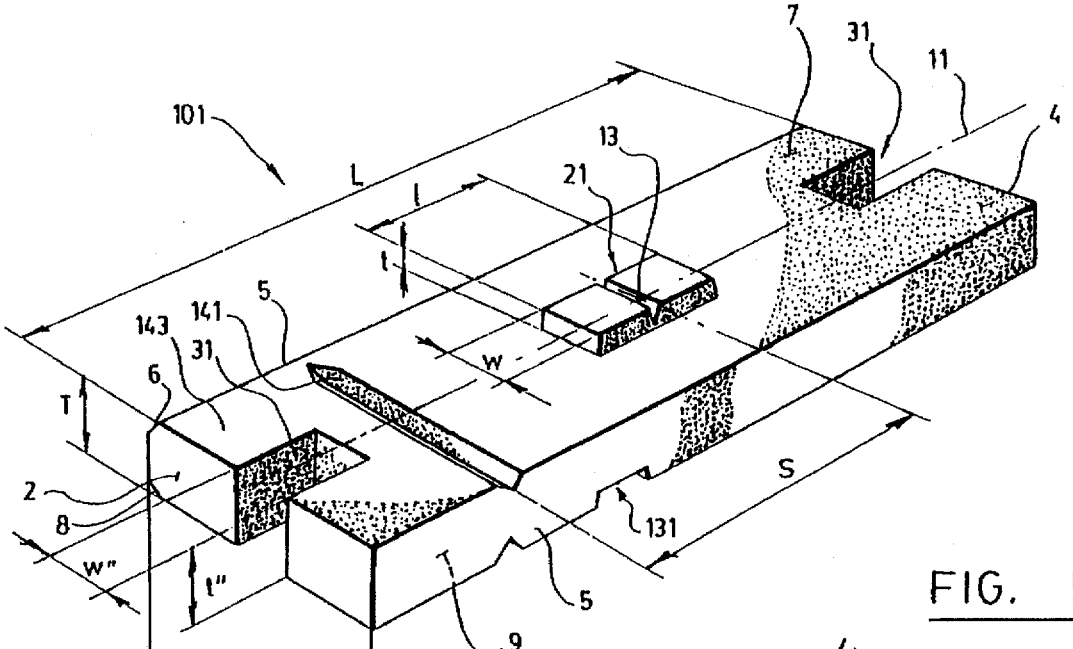
FIG. 5 is a top perspective view of a construction corner block according to the preferred embodiment of the invention.
Figure 6:
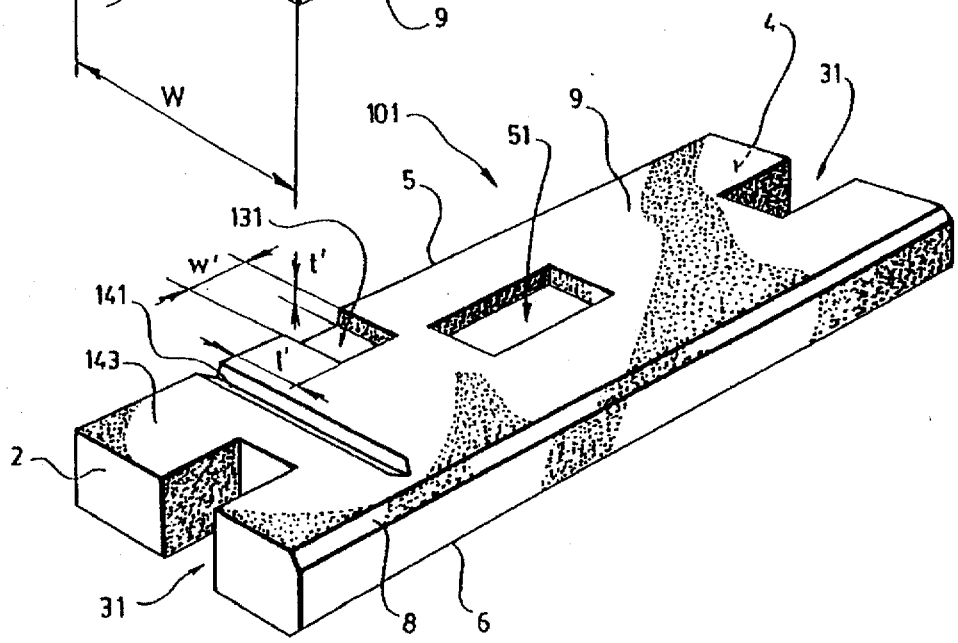
FIG. 6 is a bottom perspective view of the construction corner block of FIG. 5.
Figure 7:
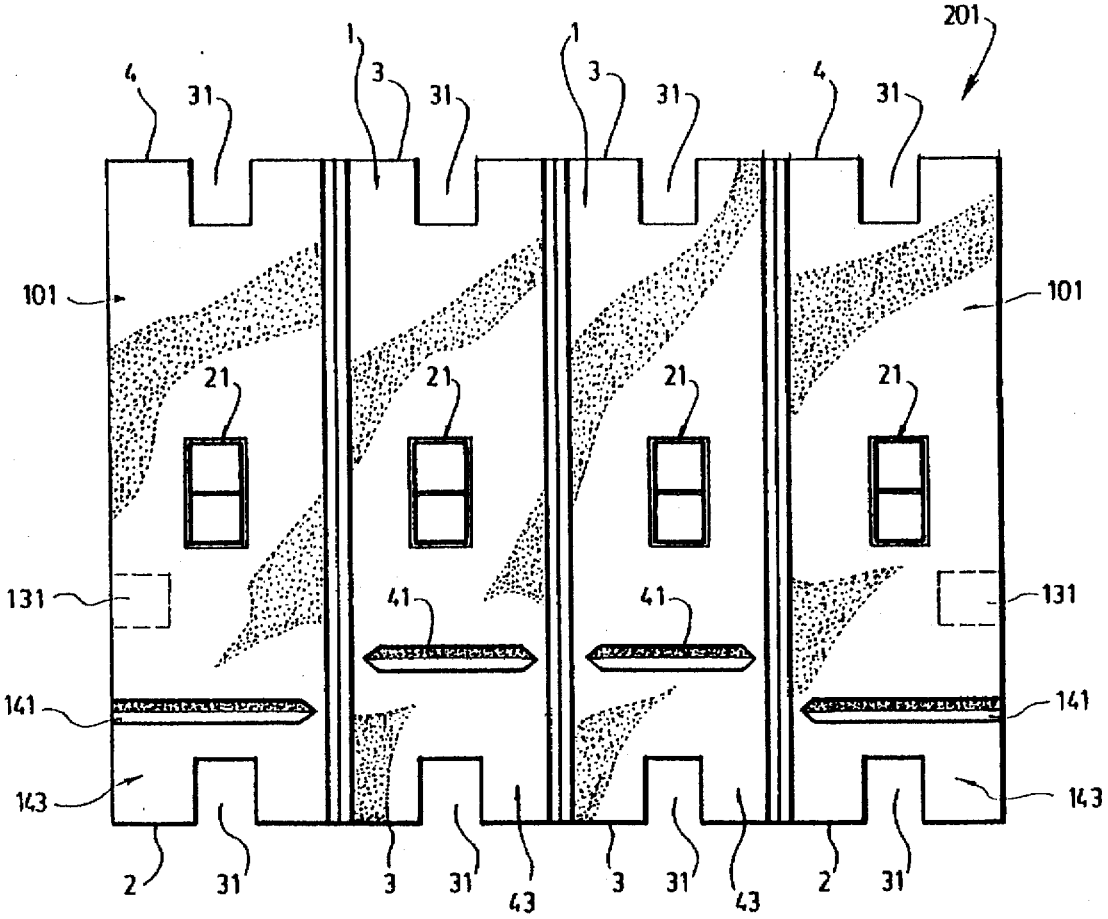
FIG. 7 is a top plan view of a multiple retaining wall unit including two construction blocks and two construction corner blocks according to the invention.

Additionally, although some of the retaining walls are straight structures, it is at times preferable to be able to turn a corner when building a retaining wall to obtain an L-shaped or a U-shaped structure. Previously, this had to be done by using a specially designed block for this specific purpose. The present invention discloses a construction corner block 101 which can be used to build a straight wall or can be used to turn a corner. The construction corner block 101 according to the invention is similar in shape and size to the construction block 1. The construction corner block 101 has a length L, a width W, a thickness T, an outside end 2, an inside end 4, two opposite sides 5, a top surface 7, a bottom surface 9, a longitudinal axis 11 and a center point 13 on the top surface 7. It is preferable for at least one of the opposite sides 5 to have bevelled edges 6, 8 as shown on FIGS. 5 and 6. For aesthetic purposes, the bevelled edge 6 is deeper than the bevelled edge 8.

The construction corner block 101 comprises a projection 21 on the top surface 7, having a length l, a width w and a thickness t, approximately centered about the center point 13. Preferably, the projection 21 is inwardly and upwardly tapered, the purpose of which will be detailed hereinafter.

The construction corner block 101 also comprises a groove 31 at the inside end 4 and at the outside end 2 on the bottom surface 9, each groove having a length l", a width w" and a thickness t", approximately centered about the longitudinal axis 11. On either the top surface 7 or the bottom surface 9 or both, there is at least one slot 141, ideally two as seen on FIGS. 5 and 6, each preferably V-shaped. Advantageously, the slot 141 on the top surface 7 is deeper than the slot 141 on the bottom surface 9. The slots 141 are transverse to the longitudinal axis 11, located at a distance S from the center point 13 near the outside end 2, defining at "corner piece" 143.

The construction corner block 101 further comprises a transverse groove 131, having an opening on one or the other of the opposite sides 5 on the bottom surface 9. The transverse groove 131 is located approximately halfway between the center point 13 and the slot 141 and has a length l', a width w', and a thickness t'. Preferably, the transverse groove 131 is inwardly and upwardly tapered, the purpose of which will be detailed hereinafter.

The length L, width W, distance S, length l, width w, thickness t, length l', width w', thickness t', length l", width w" and thickness t" are selected so that they meet the following equations:

$$l' > \tfrac{1}{2} l;$$

$$w' > w;$$

$$t' > t;$$

$$l'' > \tfrac{1}{2} l;$$

$$t'' > t;$$

$$w'' > w; \text{ and}$$

$$S = W.$$

Preferably, however, t" should equal the thickness T of the corner block.

Figure 1:
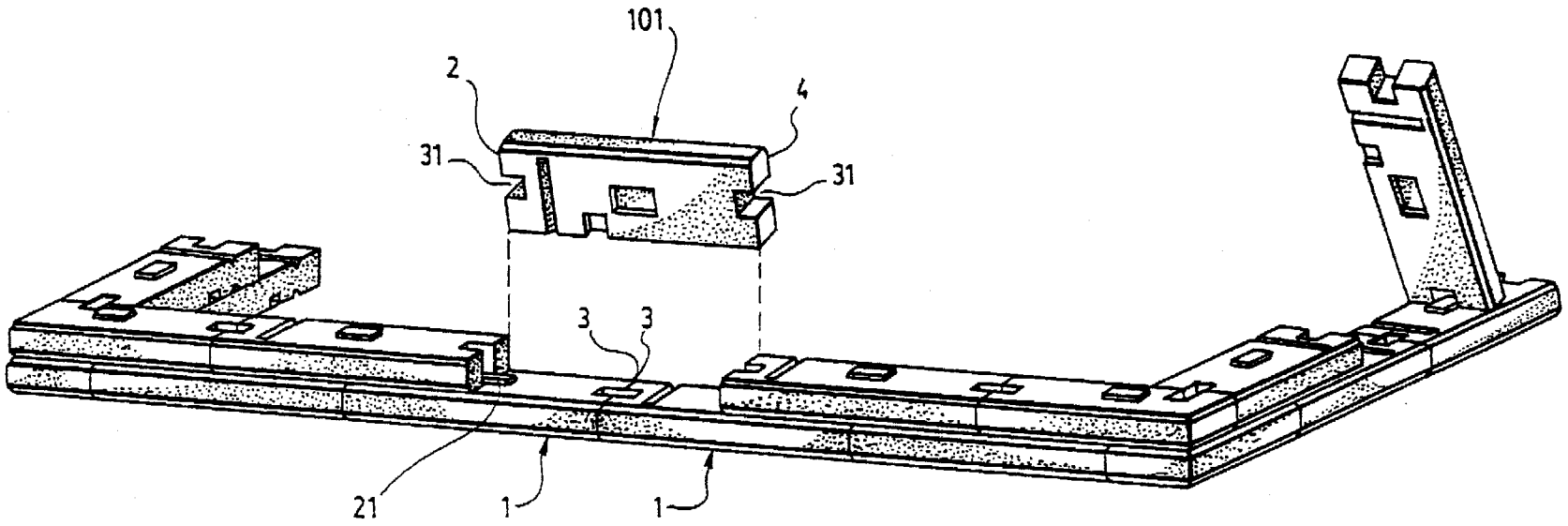
FIG. 1 is a perspective view of a retaining wall built with construction blocks according to a preferred embodiment of the invention.
Figure 2:
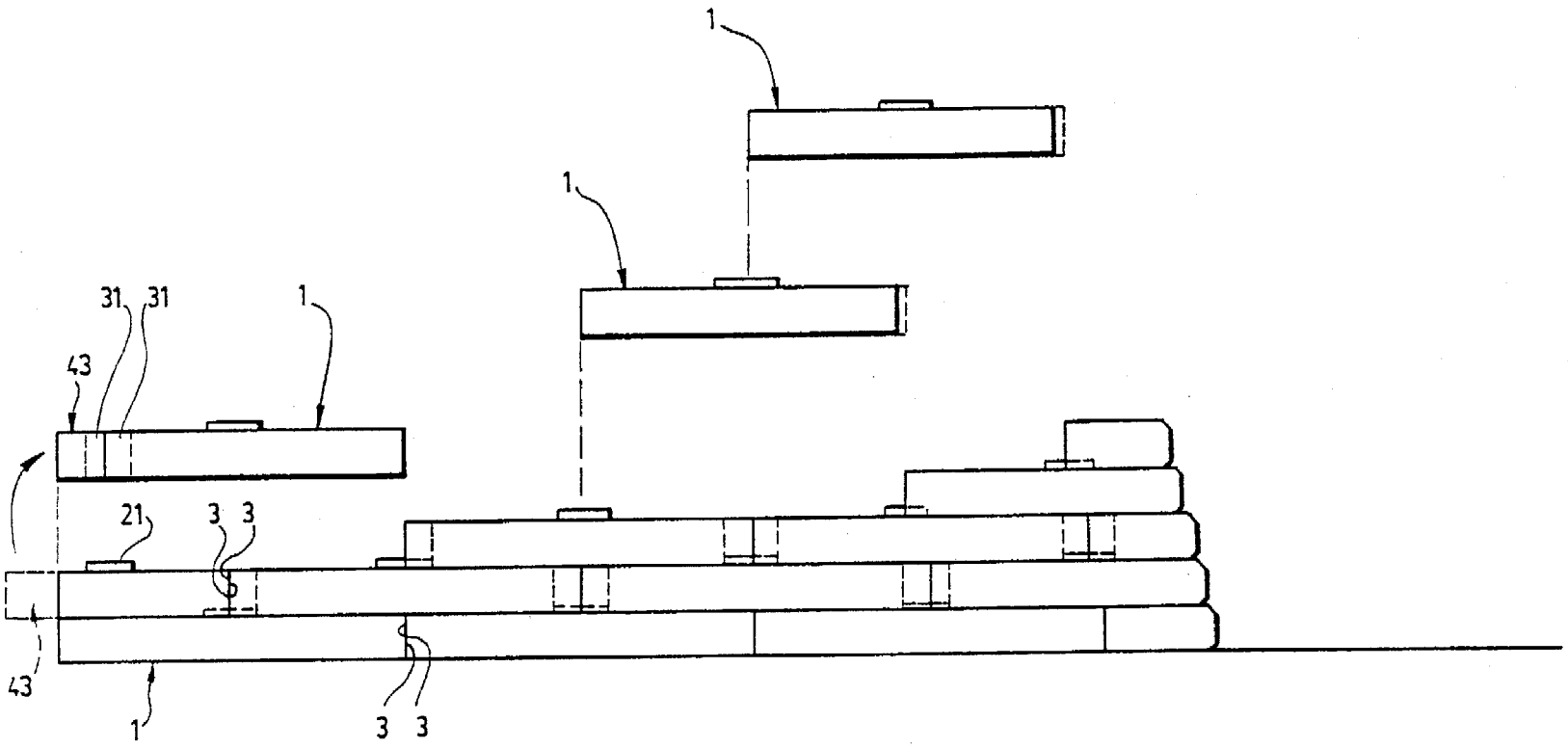
FIG. 2 is a side elevational view of the retaining wall of FIG. 1 showing how the construction blocks are staggered.

In use, the construction corner block 101 may be stacked on two identical blocks, or on two construction blocks or on a combination of a construction block and a construction corner block, having their opposite ends 3 facing each other, with the construction corner block 101 resting on half of each of the two blocks, so that the groove at one of the opposite ends of the corner block is located above half of the projection of one of the blocks and the groove at the other opposite end is located above half of the projection of the other block, thus staggering the blocks, in a fashion as that shown on FIGS. 1 and 2.

Figure 13A:
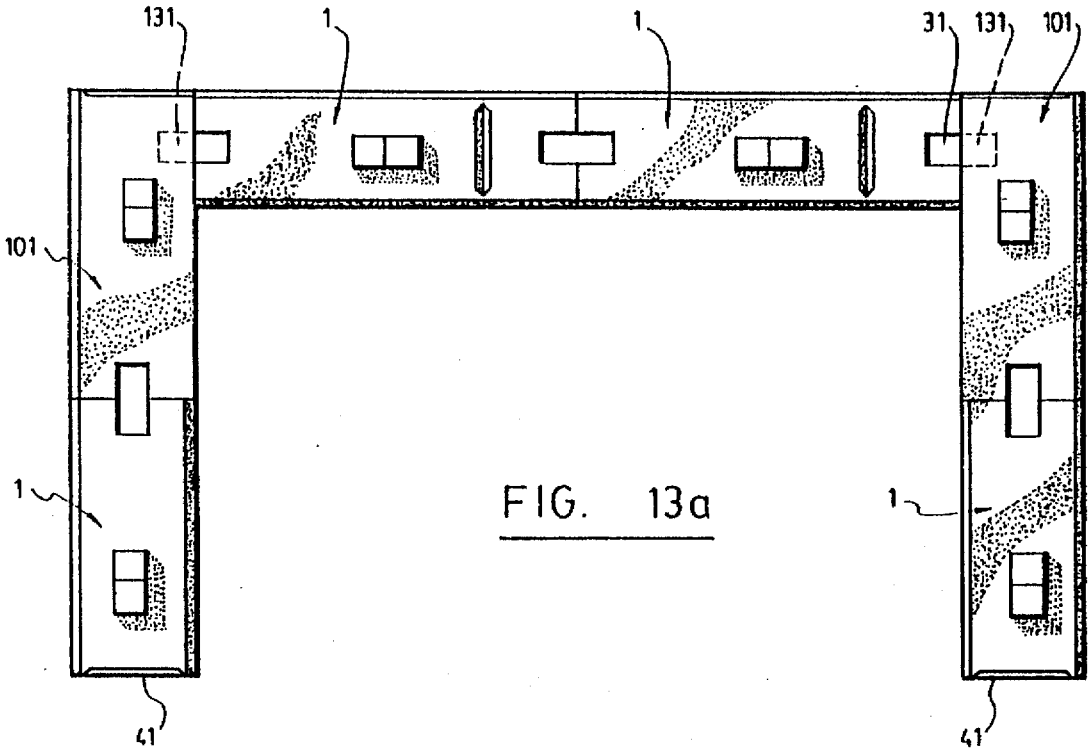
FIGS. 13A and 13B are top plan views of two rows of blocks to form a retaining wall, where
Figure 13B:
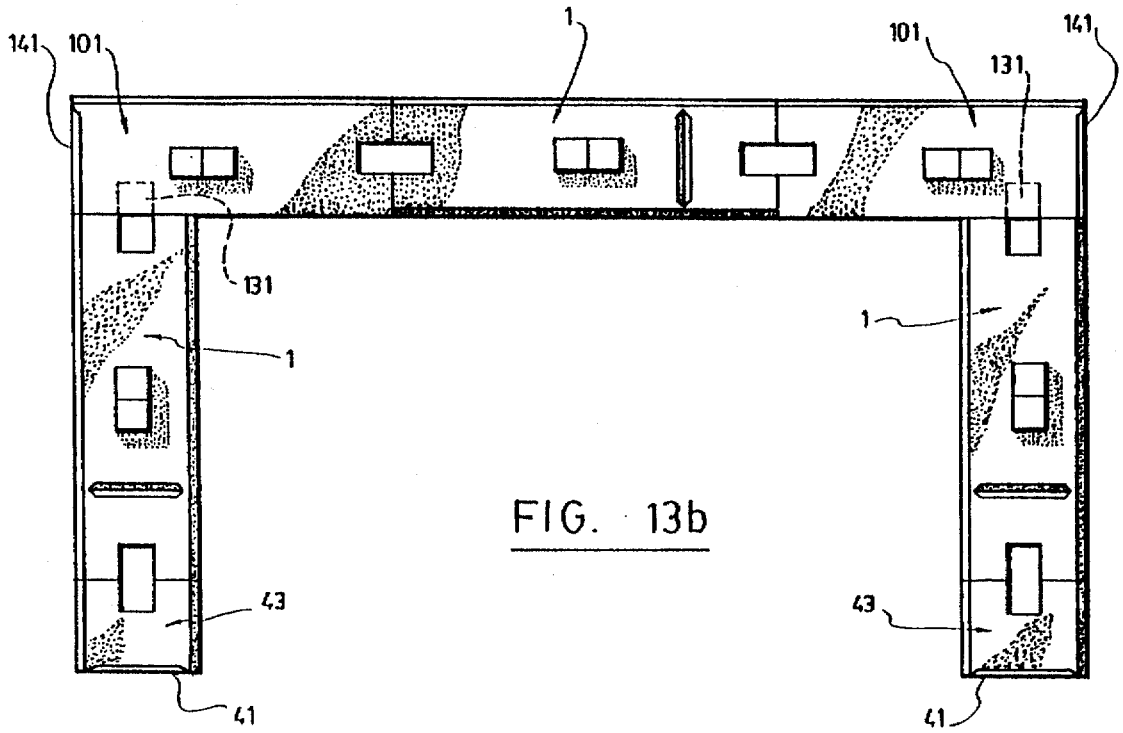

Furthermore, the construction corner block 101 may be used to form a corner by having the corner piece 143 slitted and cut off from the construction corner block 101 and have the corner block located adjacent another block 1 with their longitudinal axes 11 perpendicular to each other and have the transverse groove 131 of the corner block aligned with one of the grooves 31 of the other block 1. This embodiment is shown in FIG. 13A and 13B, where FIG. 13A shows that row that would be stacked on top of the row shown on FIG. 13B.

Preferably, the length L and the width W are selected so that they meet the following equation:

$$L = 3W.$$

Figure 14A:
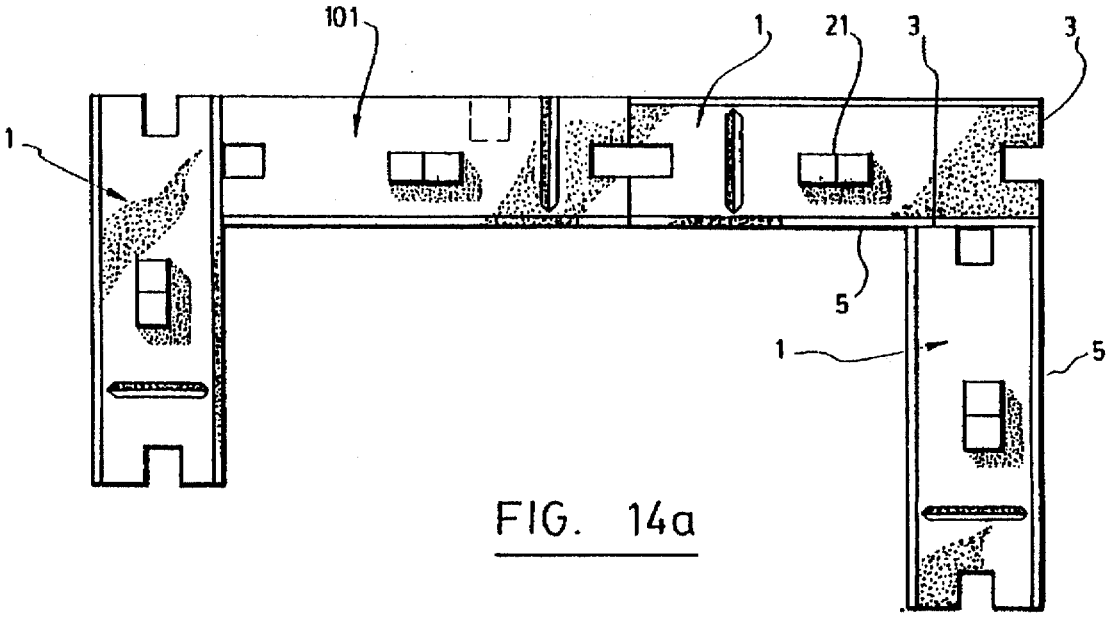
FIGS. 14A and 14B are top plan views of two rows of blocks to form a retaining wall where
Figure 14B:
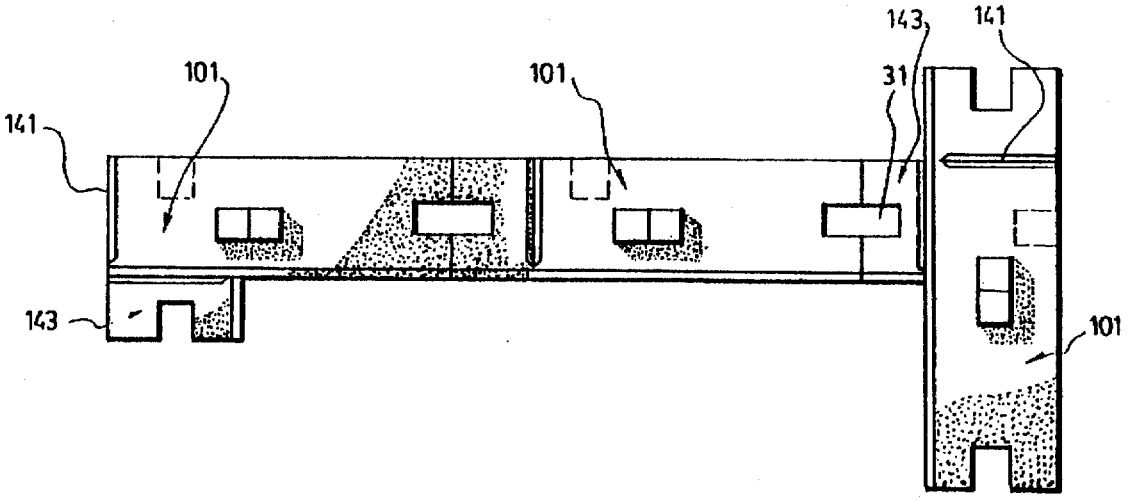

Thus, in use, the construction corner block 101 may be used to form a corner, by having the corner piece 143 slitted and cut off from the corner block 101 (see FIG. 14B) and have the corner block 101 stacked and staggered on two blocks 1, 1 (see FIG. 14A). The two blocks 1, 1 have their longitudinal axes perpendicular to each other, such that the first block 1 has one of its opposite ends 3 located adjacent one of the opposite sides 5 of the second block 1 so that one of the opposite sides 5 of the first block 1 is in line with one of the opposite ends 3 of the second block 1. The corner piece 143 is then located adjacent the corner block 101 on the second block 1 such that the groove 31 of the corner piece 143 covers half of the projection 21 of the second block 1. This embodiment is shown on FIGS. 14A and 14B, where FIG. 14A shows the row that would be stacked on top of the row shown on FIG. 14A. This manner of assembling the blocks is preferably used for building a retaining wall that is for example U-shaped as shown in FIGS. 14A and 14B, where the bevelled edges of the blocks are oriented inwardly and the earth or other material that is to be retained is on the outside of the wall. Furthermore, as shown on FIG. 14B, the corner piece 143 may or may not be slitted and cut off from the block 101 as the corner piece is located in the earth or other material to be retained.

In order to build a retaining wall which can be either inwardly or outwardly staggered, the projection 21 on the top surface of the corner block 101 is preferably offset with respect to the longitudinal axis 11. Thus, when a plurality of blocks are staggered and stacked one on top of the other in rows, the offset projection 21 results in that each row that is stacked and staggered one on top of the other is uniformly set back or set forward from the row of block below it. This feature is better shown on FIG. 2, showing an inwardly staggered wall. Preferably, the projection 21 is offset so as to gradually set back or set forward the blocks by a distance of 8 mm.

When an inwardly staggered wall is built, some blocks need to be shortened in order to allow for the gradual incline of the wall, by cutting the desired amount from the block as shown on FIG. 2. In the event that such a wall is built, and since a straight end is usually desired, the projection 21 on the construction block 1 and the construction corner block 101 advantageously comprises a transverse slit. Thus, when the blocks become smaller, it is easier to remove a section of the projection so that the subsequent block may easily fit above it.

3. Multiple Retaining Wall Unit

In order to make the transportation and storage of the above-described construction blocks and corner blocks easier, they are preferably manufactured as a unit 201. According to a preferred embodiment, the unit 201 comprises at least two construction blocks 1 that are integrally connected to each other side by side with one of the opposite sides 5 of one of the construction blocks 1 extending flat against one of the opposite sides 5 of the other main block 1 whereby the bevelled edges 6 of the opposite sides 5 make it possible for each of the main blocks 1 to be easily slitted and cut off from the remaining blocks.

The multiple retaining wall block unit 201 may further comprise at least two corner blocks 101 that are integrally connected to each other or to one or more of the construction blocks 1 side by side, whereby the bevelled edges 6 of the opposite sides 5 make it possible for each of the blocks 1 and the corner blocks 101 to be easily slitted and cut off from the remaining blocks.

Advantageously, the construction blocks 1 and the construction corner blocks 101 also comprise a recess 51 on their respective bottom surfaces 9, located opposite the projection 21, similar in shape and size to the projection 21 on the top surface 7. Thus, when a plurality of units 201 are stacked one on top of the other, the projection 21 is inserted into the recess 51. Preferably, since the projection 21 is offset with respect to the longitudinal axis 11, then so is the recess 51 so that when a plurality of units 201 are stacked one on top of the other, the stack is straight, which makes transportation and storage easier.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A construction block for building a retaining wall, said block having a length L, a width W, a thickness T, two opposite ends, two opposite sides, a top surface, a bottom surface, a longitudinal axis and a center point on said top surface, and comprising:

a projection on said top surface, said projection having a length l, a width w and a thickness t, approximately centered about said center point;

a groove at each of said opposite ends on said bottom surface, said groove having a length l", a width w" and a thickness t", approximately centered about said longitudinal axis;

at least one slot, transverse to said longitudinal axis, on either said top surface or said bottom surface, located approximately halfway between said center point and one of said opposite ends, said at least one slot defining an end piece, wherein l, w, t, l", w" and t" meet the following equations:

$$l''>\tfrac{1}{2}l;$$

$$t''>t; \text{ and}$$

$$w''>w,$$

whereby, in use, said block may be stacked on two similar blocks having their opposite ends facing each other, with said block resting on half of each of said two similar blocks, so that said groove at one of said opposite ends of said block is located above half of said projection of one of said similar blocks and said groove at the other of said opposite ends is located above half of said projection of the other similar block, thus staggering said blocks, and whereby, in use, said at least one slot makes it possible to have said end piece slitted and cut off from said block to be used as an end block for a retaining wall having a straight edge, by having said groove of said end piece located above half of said projection of said block having had its end piece slitted and cut off.

2. A block according to claim 1, wherein at least one of said opposite sides has bevelled edges.

3. A block according to claim 2, wherein said projection is inwardly and upwardly tapered.

4. A block according to claim 3, wherein said thickness t" equals said thickness T.

5. A block according to claim 4, wherein both said opposite sides have bevelled edges and wherein said block further comprises two of said at least one slot, opposite each other on said top surface and said bottom surface.

6. A block according to claim 5, wherein said projection is offset with respect to said longitudinal axis, whereby when said blocks are staggered and stacked one on top of the other in rows, said offset projection results in that each row that is stacked and staggered on top of another row is uniformly set back from the row of blocks below it.

7. A construction corner block for building a retaining wall, said corner block having a length L, a width W, a thickness T, an outside end, an inside end, two opposite sides, a top surface, a bottom surface, a longitudinal axis and a center point on said top surface, and comprising:

a projection on said top surface, said projection having a length l, a width w and a thickness t, approximately centered about said center point;

a groove at each of said opposite ends on said bottom surface, said groove having a length l", a width w" and a thickness t", approximately centered about said longitudinal axis;

at least one slot, transverse to said longitudinal axis, on either said top surface or said bottom surface, located at a distance S from said center point near said outside end, said at least one slot defining a scrap piece;

a transverse groove, having an opening on one or the other of said opposite sides on said bottom surface, said transverse groove being located approximately halfway between said center point and said slot and having a length l', a width w', and a thickness t', wherein L, W, S, l, w, t, l', w', t', l", w" and t" meet the following equations:

$$l'>\tfrac{1}{2}l;$$

$$w'>w;$$

$$t'>t;$$

$$l''>\tfrac{1}{2}l;$$

$$t''>t;$$

$$w''>w; \text{ and}$$

$$S\approx W,$$

whereby, in use, said corner block may be stacked on two similar blocks having their opposite ends facing each other, with said corner block resting on half of each of said two similar blocks, so that said groove at one of said opposite ends of said corner block is located above half of said projection of one of said similar blocks and said groove at the other of said opposite ends is located above half of said projection of the other similar block, thus staggering said blocks, and whereby, in use, said corner block may be used to form a corner by having said scrap piece slitted and cut off from said corner block and have said corner block located adjacent another similar block with their longitudinal axes perpendicular to each other and have said transverse groove of said corner block aligned with one of said grooves of said other block.

8. A corner block according to claim 7, wherein L and W meet the following equation:

$$L=3W,$$

whereby, in use, said corner block may be used to form a corner, by having said scrap piece slitted and cut off from said corner block and have said corner block stacked and staggered on two similar blocks, said two similar blocks having their longitudinal axes perpendicular to each other, the first of said similar blocks having one of its opposite ends located adjacent one of said opposite sides of the second similar block such that one of the opposite sides of the first block is in line with one of the opposite ends of the second block, and by having said scrap piece located adjacent said corner block on said second block such that said groove of said scrap piece covers half of said projection of said second block.

9. A corner block according to claim 8, wherein at least one of said opposite sides has bevelled edges.

10. A corner block according to claim 9, wherein said projection is inwardly and upwardly tapered.

11. A corner block according to claim 10, wherein said transverse groove is inwardly upwardly tapered.

12. A corner block according to claim 11, wherein said thickness t" equals said thickness T.

13. A corner block according to claim 12, wherein both said opposite sides have bevelled edges and wherein said block further comprises two of said at least one slot, opposite each other on said top surface and said bottom surface.

14. A corner block according to claim 13, wherein said projection is offset with respect to said longitudinal axis, whereby when said corner blocks are staggered and stacked one on top of the other in rows, said offset projection results in that each row that is stacked and staggered on top of another row is uniformly set back from the row of blocks below it.

15. A multiple retaining wall block unit comprising at least two main blocks as defined in claim 5 that are integrally connected to each other side by side with one of said opposite sides of one of said main blocks extending flat against one of said opposite sides of another main block, respectively, whereby, the bevelled edges of said opposite sides make it possible for each of said main blocks to be easily slitted and cut off from the remaining blocks.

16. A multiple retaining wall block unit according to claim 15, wherein said unit further comprises at least two corner blocks that are integrally connected to each other or to one or more of said main blocks side by side, said corner blocks having a length L, a width W, a thickness T, an outside end, an inside end, two opposite sides, a top surface, a bottom surface, a longitudinal axis and a center point on said top surface, and comprising:

a projection on said top surface, said projection having a length l, a width w and a thickness t, approximately centered about said center point;

a groove at each of said opposite ends on said bottom surface, said groove having a length l", a width w" and a thickness t", approximately centered about said longitudinal axis;

at least one slot, transverse to said longitudinal axis, on either said top surface or said bottom surface, located at a distance S from said center point near said outside end, said at least one slot defining a scrap piece;

a transverse groove, having an opening on one or the other of said opposite sides on said bottom surface, said transverse groove being located approximately halfway between said center point and said slot and having a length l', a width w', and a thickness t', wherein L, W, S, l, w, t, l', w', t', l", w" and t" meet the following equations:

$$l'>\tfrac{1}{2}l;$$

$$w'>w;$$

$$t'>t;$$

$$l''>\tfrac{1}{2}l;$$

$$t''>t;$$

$$w''>w;$$

$$S\approx W,$$

wherein the opposite sides of said corner block have bevelled edges, said corner block projection is inwardly and upwardly tapered, said transverse groove is inwardly and upwardly tapered and said thickness t" equals said thickness T, whereby the bevelled edges of said opposite sides make it possible for each of said blocks and said corner blocks to be easily slitted and cut off from the remaining blocks.

17. A multiple retaining wall unit according to claim 16, wherein L and W meet the following equation:

$$L=3W.$$

18. A multiple retaining wall block unit according to claim 17, wherein said main blocks and said corner blocks each have a recess on said bottom surface, opposite said projection, said recess being similar in shape and size to said projection, whereby a plurality of said multiple wall block units may be stacked one on top of the other with said projection inserted into said recess.

19. A multiple retaining wall block unit according to claim 18, wherein said projection and said recess are offset with respect to said longitudinal axis, whereby a plurality of said multiple wall block units may be stacked one on top of the other with said projection inserted into said recess, such that said stack is straight.

* * * * *